US006513470B1

(12) United States Patent
Hendriksma et al.

(10) Patent No.: US 6,513,470 B1
(45) Date of Patent: Feb. 4, 2003

(54) DEACTIVATION HYDRAULIC VALVE LIFTER

(75) Inventors: Nick John Hendriksma, Grand Rapids, MI (US); Mark James Spath, Spencerport, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/693,452

(22) Filed: Oct. 20, 2000

(51) Int. Cl.[7] ..... F01L 1/34

(52) U.S. Cl. ..... 123/90.16; 123/90.15; 123/90.5; 123/90.52; 123/90.55

(58) Field of Search ..... 123/90.16, 90.15, 123/90.39, 90.48, 90.5, 90.52, 90.55, 90.61, 90.63, 198 F

(56) References Cited

U.S. PATENT DOCUMENTS 5,090,364 A * 2/1992 McCarroll et al. ..... 123/90.16
5,255,639 A * 10/1993 Shirey et al. ..... 123/90.16
5,655,487 A * 8/1997 Mass et al. ..... 123/90.16
5,709,364 A * 1/1998 Spath ..... 123/90.16
5,893,344 A * 4/1999 Church ..... 123/90.16
5,934,232 A * 8/1999 Greene et al. ..... 123/90.16
6,092,497 A * 7/2000 Preston et al. ..... 123/90.16
6,196,175 B1 * 3/2001 Church ..... 123/90.16
6,273,039 B1 * 8/2001 Church ..... 123/90.16
6,321,704 B1 * 11/2001 Church et al. ..... 123/90.16
6,321,705 B1 * 11/2001 Fernandez et al. ..... 123/90.16
6,325,030 B1 * 12/2001 Spath et al. ..... 123/90.16

* cited by examiner

*Primary Examiner*—Teresa Walberg
*Assistant Examiner*—Fadi H. Dahbour
(74) *Attorney, Agent, or Firm*—Patrick M. Griffin

(57) ABSTRACT

A deactivation hydraulic valve lifter includes an elongate lifter body having a substantially cylindrical inner wall. The inner wall defines at least one annular pin chamber therein. The lifter body has a first end configured for engaging a cam of an engine. An elongate pin housing includes a substantially cylindrical pin housing wall and pin housing bottom. The pin housing wall includes an inner surface and an outer surface. The pin housing bottom defines a radially directed pin bore therethrough. The pin housing is concentrically disposed within the inner wall of the lifter body such that the outer surface of the pin housing wall is adjacent to at least a portion of the inner wall of the lifter body. A plunger having a substantially cylindrical plunger wall with an outer surface is concentrically disposed within the pin housing such that the outer surface of the plunger wall is adjacent to at least a portion of the inner surface of the pin housing wall. A deactivation pin assembly is disposed within the pin bore and includes two pin members. The pin members are biased radially outward relative to each other. A portion of each pin member is disposed within the annular pin chamber to thereby couple the lifter body to the pin housing. The pin members are configured for moving toward each other when the pin chamber is pressurized, thereby retracting the pin members from within the annular pin chamber and decoupling the lifter body from the pin housing.

25 Claims, 6 Drawing Sheets

DEACTIVATION HYDRAULIC VALVE LIFTER

CROSS-REFERENCE TO RELATED APPLICATIONS

This application is a continuation-in-part of U.S. patent application Ser. No. 09/607,071, filed Jun. 29, 2000 and entitled Valve Lifter Assembly for Selectively Deactivating a Cylinder, which claims the benefit of U.S. Provisional Patent Application Ser. No. 60/141,985, filed Jul. 1, 1999.

TECHNICAL FIELD

The present invention relates to hydraulic valve lifters for use with internal combustion engines, and, more particularly, to a lifter-based device which accomplishes cylinder deactivation in push-rod engines.

BACKGROUND OF THE INVENTION

Automobile emissions include hydrocarbons, nitrogen oxides ($NO_x$), carbon monoxide (CO) and carbon dioxide ($CO_2$) as a result of the combustion process. The Clean Air Act of 1970 and the 1990 Clean Air Act set goals for industry to reduce emissions from vehicles and other pollution sources. Standards set by the 1990 Clean Air Act limit automobile emissions to 0.25 grams per mile (gpm) of non-methane hydrocarbons and 0.4 gpm of nitrogen oxides. It is predicted that these standards will be reduced to one-half these levels by the year 2004. It is expected that automobiles will continue to be powered by internal combustion engines for decades to come. As the population increases, and standards of living rise, so will the demand for automobiles. This demand is predicted to be especially great in developing countries. An increasing number of automobiles will cause a proportionate increase in pollution if everything else remains constant. There is a major challenge facing automobile manufacturers to reduce undesirable emissions of hyrdrocarbons, $NO_x$, CO and $CO_2$ while improving fuel economy, thereby assuring the increased number of automobiles has a lessened impact on the environment. One method by which automobile manufacturers have attempted to improve fuel economy and reduce undesirable emissions is cylinder deactivation.

Cylinder deactivation is the deactivation of the intake and/or exhaust valves of a cylinder or cylinders during at least a portion of the combustion process, and is a proven method by which fuel economy can be improved. In effect, cylinder deactivation reduces the number of engine cylinders within which the combustion process is taking place. With fewer cylinders performing combustion, fuel efficiency is increased and the amount of pollutants emitted from the engine will be reduced. For example, in an eight-cylinder engine under certain operating conditions, four of the eight cylinders can be deactivated. Thus, combustion would be taking place in only four, rather than in all eight, cylinders. Cylinder deactivation is effective, for example, during part-load conditions when full engine power is not required for smooth and efficient engine operation. In vehicles having large displacement push rod engines, studies have shown that cylinder deactivation can improve fuel economy by as much as fifteen percent.

The reliability and performance of the large displacement push rod engines was proven early in the history of the automobile. The basic designs of the large displacement push rod engines in use today have remained virtually unchanged for approximately thirty years, due, in part, to the popularity of such engines; the reluctance of the consumer to accept changes in engines; and the tremendous cost in designing, tooling, and testing such engines. Conventional methods of achieving cylinder deactivation, however, are not particularly suited to large displacement push rod engines. These conventional methods typically require the addition of components which do not fit within the space occupied by existing valve train components. Thus, the application of conventional methods of achieving cylinder deactivation have necessitated major design changes in such engines.

Therefore, what is needed in the art is a device which enables cylinder deactivation in large displacement push rod engines where the device is designed to fit within the existing space occupied by conventional drive train components, thereby avoiding the need to redesign such engines.

SUMMARY OF THE INVENTION

The present invention provides a deactivation hydraulic valve lifter for use in a push rod internal combustion engine. The valve lifter can be selectively deactivated such that a valve associated with the valve lifter is not operated, thereby selectively deactivating the engine cylinder.

The invention includes, in one form thereof, a deactivation hydraulic valve lifter including an elongate lifter body having a substantially cylindrical inner wall. The inner wall defines at least one annular pin chamber therein. The lifter body has a lower end configured for engaging a surface of a cam. An elongate pin housing includes a substantially cylindrical pin housing wall and pin housing bottom. The pin housing wall includes an inner surface and an outer surface. A radially directed pin bore extends through the pin housing bottom. The pin housing is concentrically disposed within the inner wall of the lifter body such that the outer surface of the pin housing wall is adjacent to at least a portion of the inner wall of the lifter body. A plunger having a substantially cylindrical plunger wall with an outer surface is concentrically disposed within the pin housing such that the outer surface of the plunger wall is adjacent to at least a portion of the inner surface of the pin housing wall. A deactivation pin assembly is disposed within the pin bore and includes two pin members. The pin members are biased radially outward relative to each other. A portion of each pin member is disposed within the annular pin chamber to thereby couple the lifter body to the pin housing. The pin members are configured for moving toward each other when the pin chamber is pressurized, thereby retracting the pin members from within the annular pin chamber and decoupling the lifter body from the pin housing.

An advantage of the present invention is that it is received within standard-sized engine bores which accommodate conventional hydraulic valve lifters.

Another advantage of the present invention is that the deactivation pin assembly includes two pin members, thereby increasing the rigidity, strength, and operating range of the deactivation hydraulic valve lifter.

Yet another advantage of the present invention is that no orientation of the pin housing relative to the lifter body is required.

A still further advantage of the present invention is that the pin housing is free to rotate relative to the lifter body, thereby evenly distributing wear on the annular pin chamber.

An even further advantage of the present invention is that an external lost motion spring permits the use of a larger sized hydraulic element and operation under higher engine oil pressure.

Lastly, an advantage of the present invention is that lash can be robustly and accurately set to compensate for manufacturing tolerances.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENT

Figure 1:
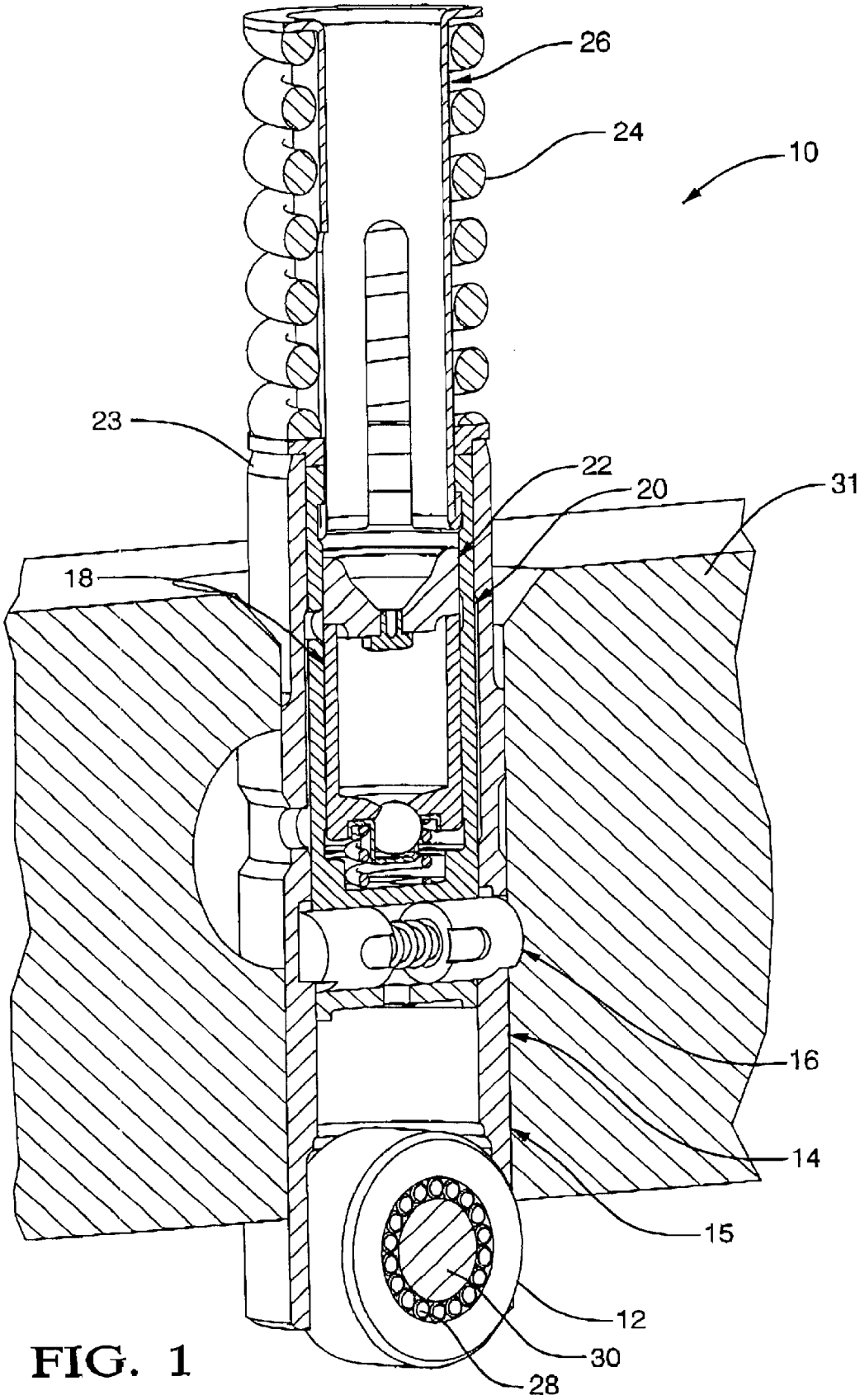
FIG. 1 is a partially sectioned, perspective view of one embodiment of the deactivation roller hydraulic valve lifter of the present invention.

Referring now to the drawings and particularly to FIG. 1, there is shown one embodiment of a deactivation roller hydraulic valve lifter of the present invention, having a roller bearing for engagement with the cam. Deactivation roller hydraulic valve lifter (DRHVL) 10 includes roller 12, lifter body 14, deactivation pin assembly 16, plunger assembly 18, pin housing 20, pushrod seat assembly 22, spring seat 23, lost motion spring 24, and spring tower 26. As will be more particularly described hereinafter, plunger assembly 18 is disposed concentrically within pin housing 20 which, in turn, is disposed concentrically within lifter body 14. Pushrod seat assembly 22 is disposed concentrically within pin housing 20 above plunger assembly 18. Roller 12 is associated with lifter body 14. Roller 12 rides on the cam of an internal combustion engine and is displaced vertically thereby. Roller 12 translates the rotary motion of the cam to vertical motion of lifter body 14. Deactivation pin assembly 16 normally engages lifter body 14, thereby transferring the vertical reciprocation of lifter body 14 to pin housing 20 and, in turn, to plunger assembly 18 and pushrod seat assembly 22. In this engaged position, the vertical reciprocation of DRHVL 10 opens and closes a valve of the internal combustion engine. Deactivation pin assembly 16 disengages to decouple lifter body 14 from pin housing 20 and, in turn, decouples plunger assembly 18 and pin housing 20 from the vertical reciprocation of lifter body 14. Thus, when deactivation pin assembly 16 is in the disengaged position, only lifter body 14 undergoes vertical reciprocation.

Roller 12 is of conventional construction, having the shape of a hollow cylindrical member within which bearings 28 are disposed and retained. Roller 12 is disposed within a first end 15 of lifter body 14. Shaft 30 passes through roller 12 such that bearings 28 surround shaft 30, bearings 28 being disposed intermediate shaft 30 and the inside surface of roller 12. Shaft 30 is attached by, for example, staking to lifter body 14. Lifter body 14 includes on its outside surface anti-rotation flats (not shown) which are aligned with anti-rotation flats on an interior surface of a conventional anti-rotation guide (not shown) within which lifter body 14 of DRHVL 10 is inserted. This assembly is placed in the lifter bore of push-rod type engine 31. Roller 12 rides on the cam (not shown) of push-rod type engine 31. Roller 12 is constructed of, for example, hardened or hardenable steel or ceramic material.

Figure 2A:
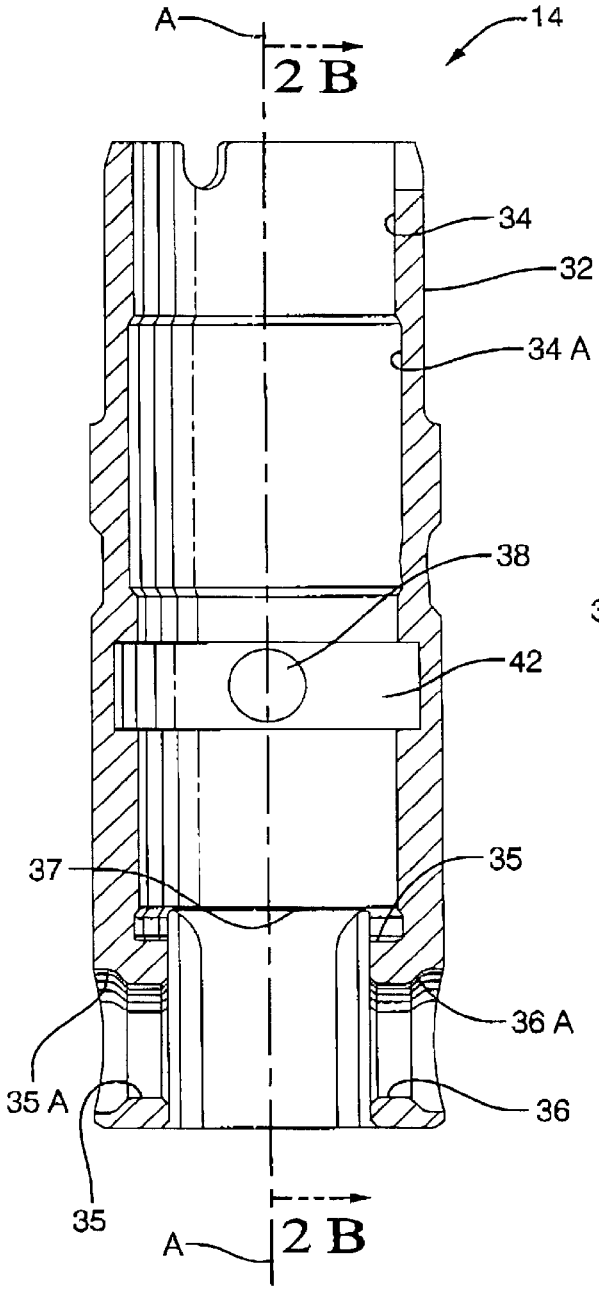
FIG. 2A is an axial cross-sectional view of the lifter body of claim 1.
Figure 2B:
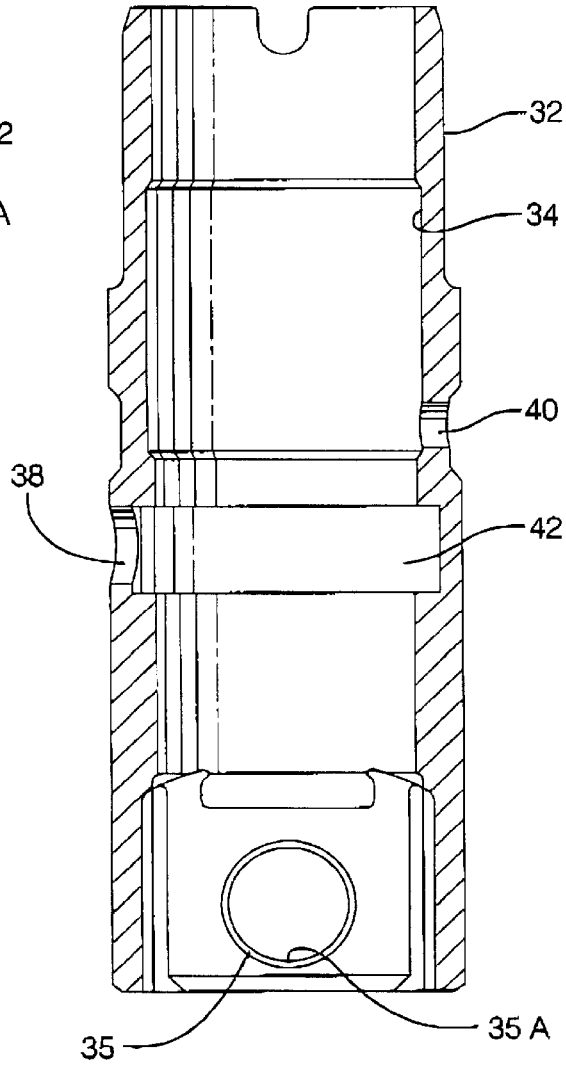
FIG. 2B is an axial cross-sectional view of the lifter body of claim 1 rotated by 90 degrees.

Referring now to FIGS. 2*a* and 2*b*, lifter body 14 is an elongate cylindrical member dimensioned to be received within the space occupied by a standard roller hydraulic valve lifter. For example, lifter body 14 has a diameter of approximately 0.842 inches. Lifter body 14 has central axis A and includes cylindrical wall 32 having an inner surface 34. Inner surface 34 includes circumferential oil supply recess 34a. Diametrically opposed shaft orifices 35 and 36 are defined in cylindrical wall 32 and include rim portions 35*a* and 36*a*, respectively. Rim portions 35*a* and 36*a* have a diameter that is slightly greater than the diameter of shaft orifices 35 and 36, respectively. Shaft 30 passes through shaft orifice 35, extends diametrically through roller 12, and at least partially into shaft orifice 36. One end of shaft 30 is disposed in rim portion 35*a* and the other end of shaft 30 is disposed within rim portion 36*a*. The slightly larger diameter of rim portions 35*a* and 36*a* relative to shaft orifices 35 and 36 enables shaft 30 to be attached, such as, for example, by staking to lifter body 14. Cylindrical wall 32 defines roller pocket 37 intermediate shaft orifices 35 and 36, which receives roller 12.

Cylindrical wall 32 defines control port 38 and oil port 40. Inner surface 34 of cylindrical wall 32 defines annular pin chamber 42 therein. Preferably, annular pin chamber 42 is a contiguous chamber of a predetermined axial height, and extends around the entire circumference of inner surface 34 of cylindrical wall 32. Control port 38 is defined by one opening which extends through cylindrical wall 32, terminating at and opening into annular pin chamber 42. Thus, control port 38 provides a fluid passageway through cylindrical wall 32 and into annular pin chamber 42. Pressurized oil is injected through control port 38 into annular pin chamber 42 in order to retract deactivation pin assembly 16 from within annular pin chamber 42. Oil port 40 passes through cylindrical wall 32 and into oil supply recess 34*a*, thereby providing a passageway for lubricating oil to enter the interior of lifter body 14. Lifter body 14 is constructed of, for example, hardened or hardenable steel.

Figure 3:
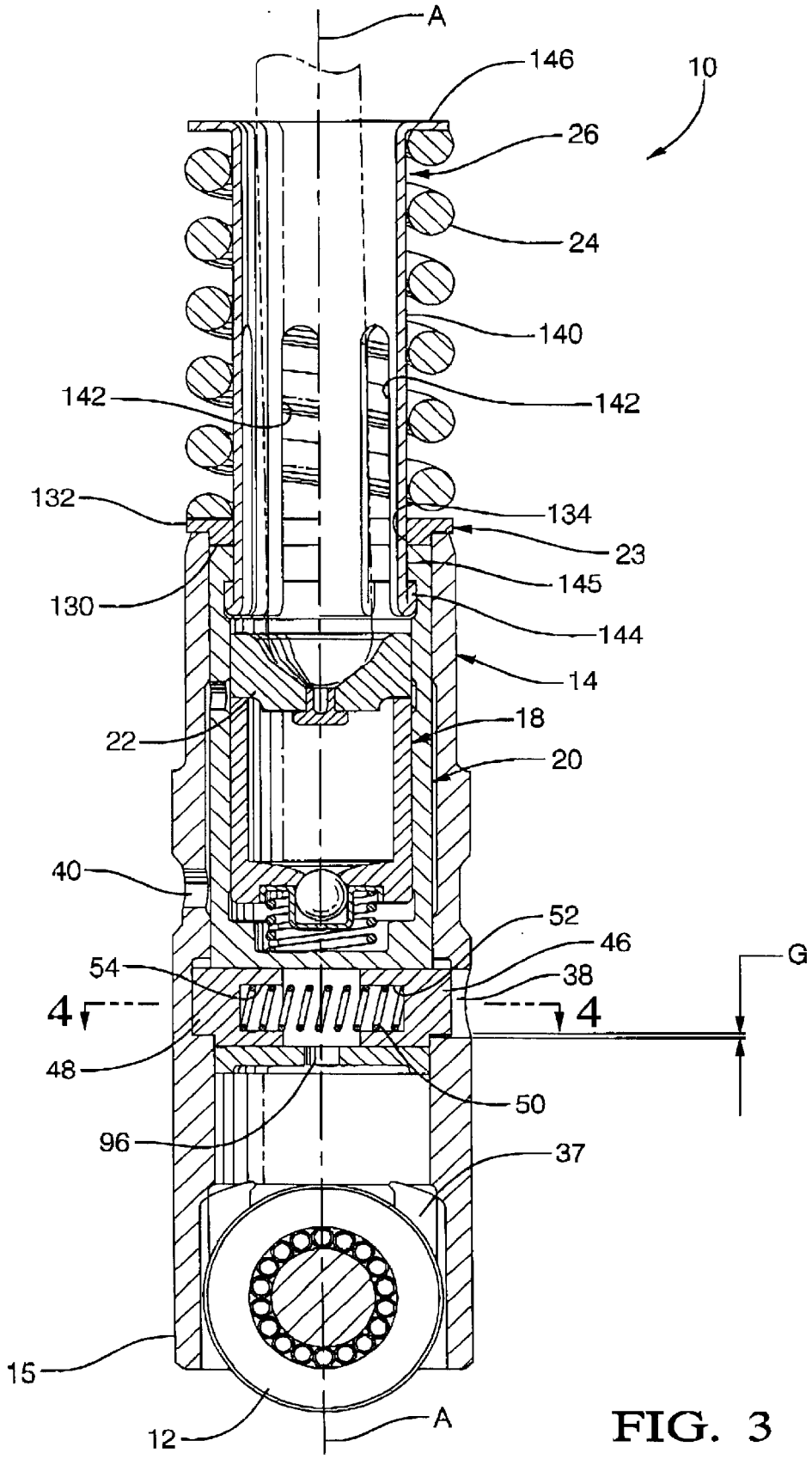
FIG. 3 is an axial cross-sectional view of FIG. 1.
Figure 4:
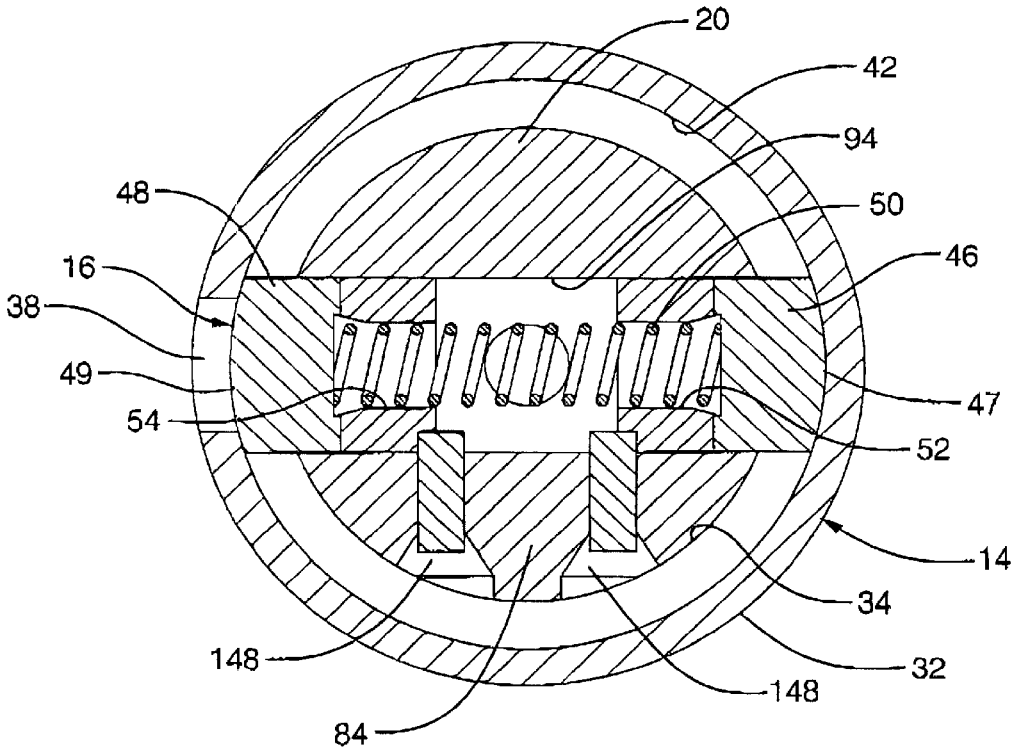
FIG. 4 is a radial cross-sectional view of FIG. 3 taken along line 4—4.
Figure 5:
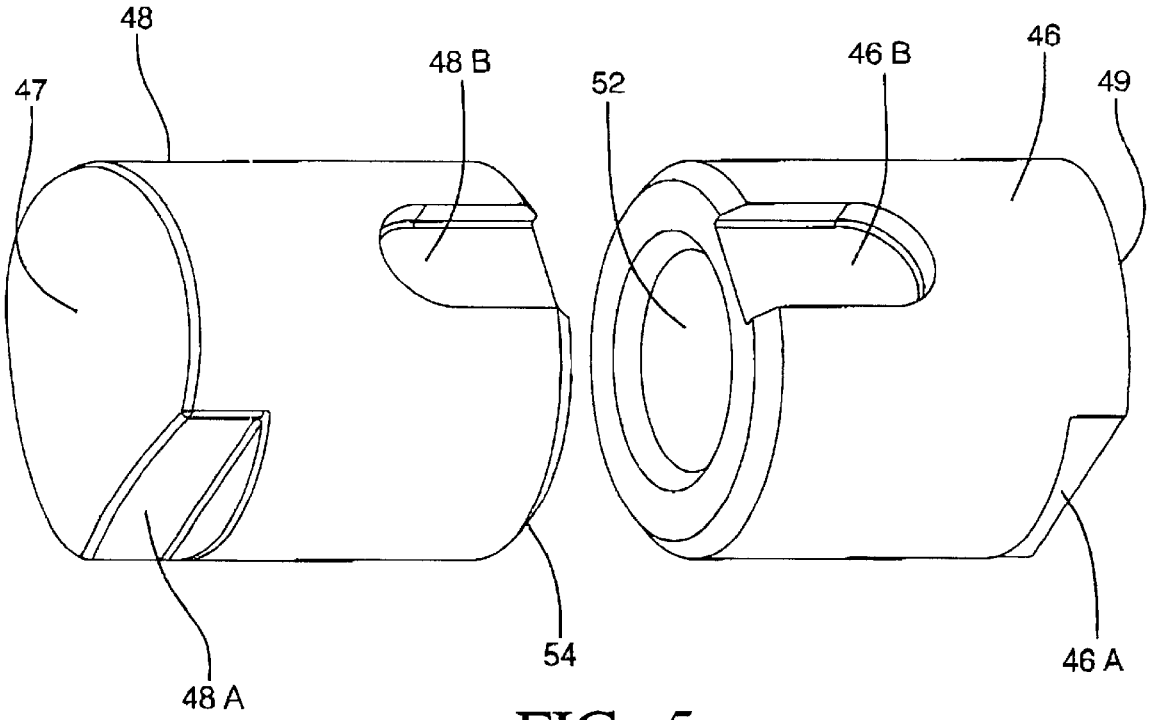
FIG. 5 is a perspective view of the pin members of FIG. 1.

As best shown in FIGS. 3 and 4, deactivation pin assembly 16 includes two pin members 46, 48 interconnected by and biased radially outward relative to lifter body 14 by pin spring 50. As shown in FIG. 5, each of pin members 46, 48 are round pins having stepped flats 46*a* and 48*a* which are dimensioned to be received within annular pin chamber 42. As will be described with more particularity hereinafter, a small gap G is provided between flats 46*a*, 48*a* and the lower edge of annular pin chamber 42. Gap G provides for clearance between flats 46*a* and 48*a* and the lower edge of annular pin chamber 42, thereby allowing for free movement of pin members 46 and 48 into pin chamber 42. Each of pin members 46 and 48 include at one end pin faces 47 and 49, respectively, and define pin bores 52 and 54, respectively, at each opposite end. Each of pin bores 52 and 54 receive a corresponding end of pin spring 50. In its normal or default position, pin members 46 and 48 of deactivation pin assembly 16 are biased radially outward by pin spring 50 such that at least a portion of each pin member 46 and 48 is disposed within annular pin chamber 42 of lifter body 14. Preferably, pin faces 47 and 49 have a radius of curvature that corresponds to but is a predetermined amount less than the curvature of inner surface 34 of cylindrical wall 32. Thus, line contact, rather than point contact, is provided between pin faces 47, 49 and the inner surface of pin chamber 42 upon initial engagement of pin members 46, 48 within pin chamber 42. Further, the slightly smaller curvature of pin faces 47, 49 provides a large active surface area against which the pressurized oil injected into annular pin chamber 42 acts to move pin members 46 and 48 radially toward each other to thereby retract pin members 46 and 48 from engagement within annular pin chamber 42. Each of pin members 46, 48 include stop grooves 46*b* and 48*b*, respectively. Stop grooves 46*b*, 48*b* extend a predetermined distance from the end of each pin member 46, 48 that is opposite pin faces 47, 49, respectively. Pin members 46 and 48 are constructed of, for example hardened or hardenable steel. Pin spring 50 is a coil spring constructed of, for example, music wire.

Figure 6:
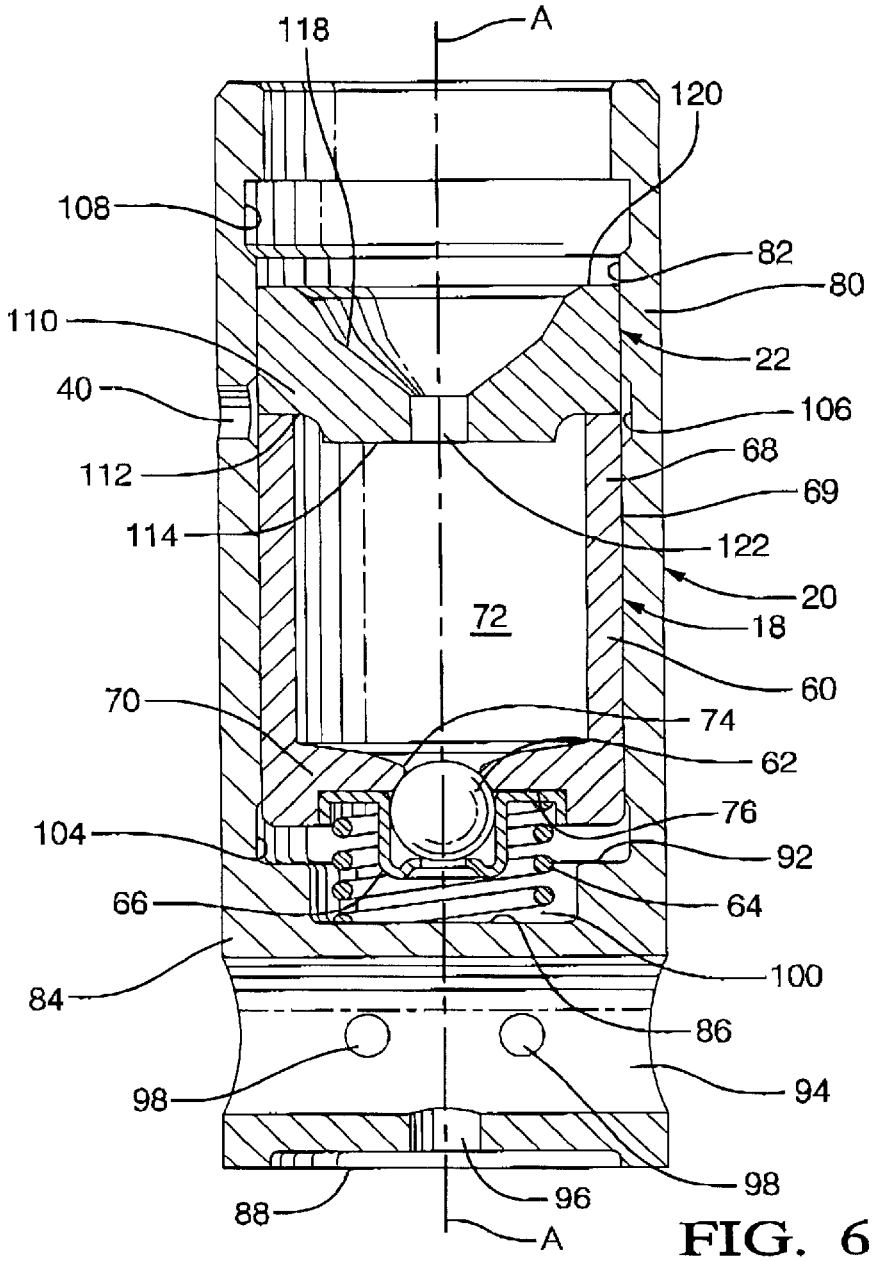
FIG. 6 is an axial cross-sectional view of the pin housing, plunger assembly, and push rod seat of FIG. 1.

Referring now to FIG. 6, plunger assembly 18 is disposed within pin housing 20 which, in turn, is disposed within lifter body 14. Plunger assembly 18 includes plunger 60, plunger ball 62, plunger spring 64 and ball retainer 66. Plunger 60 is a cup shaped member including a cylindrical side wall 68, having an outer surface 69, and a plunger bottom 70, and is slidably disposed concentrically within pin housing 20. Plunger side wall 68, bottom 70, and pushrod seat assembly 22 conjunctively define low-pressure chamber 72. Plunger bottom 70 includes plunger orifice 74 and seat 76. Plunger orifice 74 is circular in shape, having a predetermined diameter, and is concentric with plunger cylindrical side wall 68. Seat 76 is a recessed area defined by plunger bottom 70. Plunger 60 is constructed of, for example, hardenable or hardened steel. Plunger ball 62 is movably disposed within ball retainer 66, which, in turn, is disposed within seat 76 adjacent plunger bottom 70. Plunger spring 64 is a coil spring and is disposed between pin housing 20 and plunger assembly 18. More particularly, plunger spring 64 is disposed between seat 76 of plunger bottom 70 and pin housing 20, pressing ball retainer 66 against seat 76 of plunger bottom 70. In that position, plunger ball 62 and ball retainer 66 conjunctively define a ball-type check valve. Plunger ball 62 is a spherical ball of a predetermined circumference such that plunger ball 62 is movable within ball retainer 66 toward and away from plunger orifice 74, and seals plunger orifice 74 in a fluid tight manner. Plunger ball 62 is constructed of, for example, hardenable or hardened steel.

Pin housing 20 includes cylindrical side wall 80, having an inner surface 82, and bottom portion 84. Bottom portion 84 includes a bottom inner surface 86 and an outer surface 88. Bottom inner surface 86 is in the form of a cylindrical indentation which is surrounded by ledge 92. Bottom portion 84 defines a cylindrical deactivation pin bore 94 radially therethrough. Deactivation pin assembly 16 is disposed within deactivation pin bore 94. Drain aperture 96 is also defined by bottom portion 84 and extends from deactivation pin bore 94 through to outer surface 88 of bottom portion 84. Bottom 84 further defines two stop pin apertures 98 therein. Stop pin apertures 98 are parallel relative to each other and perpendicular relative to deactivation pin bore 94. Stop pin apertures 98 extend through side wall 80 radially inward through bottom 84, intersecting with and terminating in deactivation pin bore 94. Inner surface 82 of side wall 80 defines a lower annular groove 104 proximate to and extending a predetermined distance above ledge 92. Inner surface 82 also defines an intermediate annular groove 106 and an upper annular groove 108. Pin housing 20 is free to rotate relative to lifter body 14, and thus is not rotationally constrained within lifter body 14. Pin housing 20 is constructed of, for example, hardenable or hardened steel.

High pressure chamber 100 is conjunctively defined by bottom inner surface 86 of pin housing 20, plunger bottom 70, and the portion of inner surface 82 of cylindrical side wall 80 disposed therebetween. Plunger orifice 74 provides a passageway for the flow of fluid, such as, for example, oil, between high pressure chamber 100 and low pressure chamber 72. The ball-type check valve formed by plunger ball 62 and ball retainer 66 selectively controls the ability of the fluid to flow through plunger orifice 74.

Figure 7:
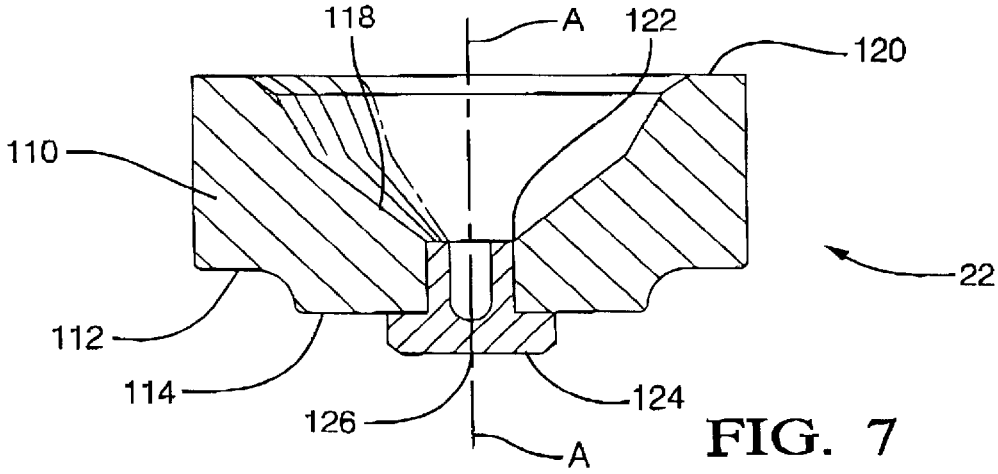
FIG. 7 is an axial cross-sectional view of the push rod seat of FIG. 1.

Referring now to FIG. 7, pushrod seat assembly 22 includes cylindrical plug body 110 having a bottom surface 112 with a circumferential seat ring 114. Opposite bottom surface 112 is a bowl shaped socket 118 surrounded by shelf 120. Pushrod seat assembly 22 is disposed concentrically within pin housing 20 such that bottom surface 112 is adjacent to the top of side wall 68 of plunger 60. Plug body 110 defines pushrod seat orifice 122, which is concentric with plug body 110 and extends axially from bottom surface 112 through to socket 118. Insert 124 is inserted, such as, for example, by pressing, into pushrod seat orifice 122. Insert 124 carries an insert orifice 126 having a very small diameter of, for example, about 0.1 to 0.4 mm. Insert 124 is disposed within pushrod seat orifice 122 such that pushrod seat orifice 122 and insert orifice 126 are concentric and in fluid communication with each other. Pushrod seat 22 and insert 124 are constructed of, for example, hardenable or hardened steel.

Spring seat 23, as best shown in FIG. 3, is a ring-shaped member, having collar 130, flange 132, and orifice 134. Collar 130 is disposed concentrically within lifter body 14 and adjacent to the top edge of side wall 80 of pin housing 20. Flange 132 extends radially from collar 130 such that flange 132 overlaps onto the top edge of cylindrical wall 32 of lifter body 14. The height of gap G is determined by the dimensions of spring seat 23. More particularly, the length of the axial extension of collar 130 into lifter body 14 determines the axial position of pin housing 20 relative to lifter body 14, thereby determining the height of gap G.

Lost motion spring 24, as best shown in FIG. 3, is a coil spring having one end associated with spring seat 23 and the other end associated with spring tower 26. Lost motion spring 24 has a predetermined installed load which is selected to prevent hydraulic element pump up due to oil pressure in high pressure chamber 100 and due to the force exerted by plunger spring 64. Lost motion spring 24 is constructed of, for example, hardenable or hardened steel.

Spring tower 26, as best shown in FIG. 3, is an elongate cylindrical member having an outer wall 140. A plurality of slots 142 are defined in outer wall 140. Tabs 144 are formed along the bottom end 145 of outer wall 140. A portion of outer wall 140 is concentrically disposed within pin housing 20, adjacent to inner surface 82 of side wall 80. Slots 142 enable spring tower 26 to be flexible enough to be pushed downward into pin housing until each of tabs 144 are received within and snap into or engage upper annular groove 108 formed in side wall 80 of pin housing 20. Spring tower 26 defines at its top end tower flange 146, which is associated with the top end of lost motion spring 26. The lower end of spring tower 26, disposed within pin housing 20, acts to limit the extended height of pushrod seat assembly 22.

Stop pins 148, as best shown in FIG. 4, are, for example, pressed into stop pin apertures 98, and extend a predetermined distance into deactivation pin bore 94 of pin housing 20. Stop pins 148 are configured for restricting the inward retraction of pin members 46 and 48 of deactivation pin assembly 16. A respective end of each stop pin 148 is disposed within a corresponding one of stop grooves 46*b* and 48*b* of pin members 46, 48, thereby preventing the undesirable condition of pin shuttle. Generally, pin shuttle occurs when a deactivation pin or pin member is radially displaced or pushed to one side or the other of a housing and is therefore unable to completely disengage from within an orifice or deactivation chamber. Further, stop pins 148 in conjunction with stop grooves 46*b*, 48*b* prevent excessive rotation of pin members 46, 48 relative to pin housing 20. Stop pins 148 are constructed of, for example, hardenable or hardened steel.

Figure 8:
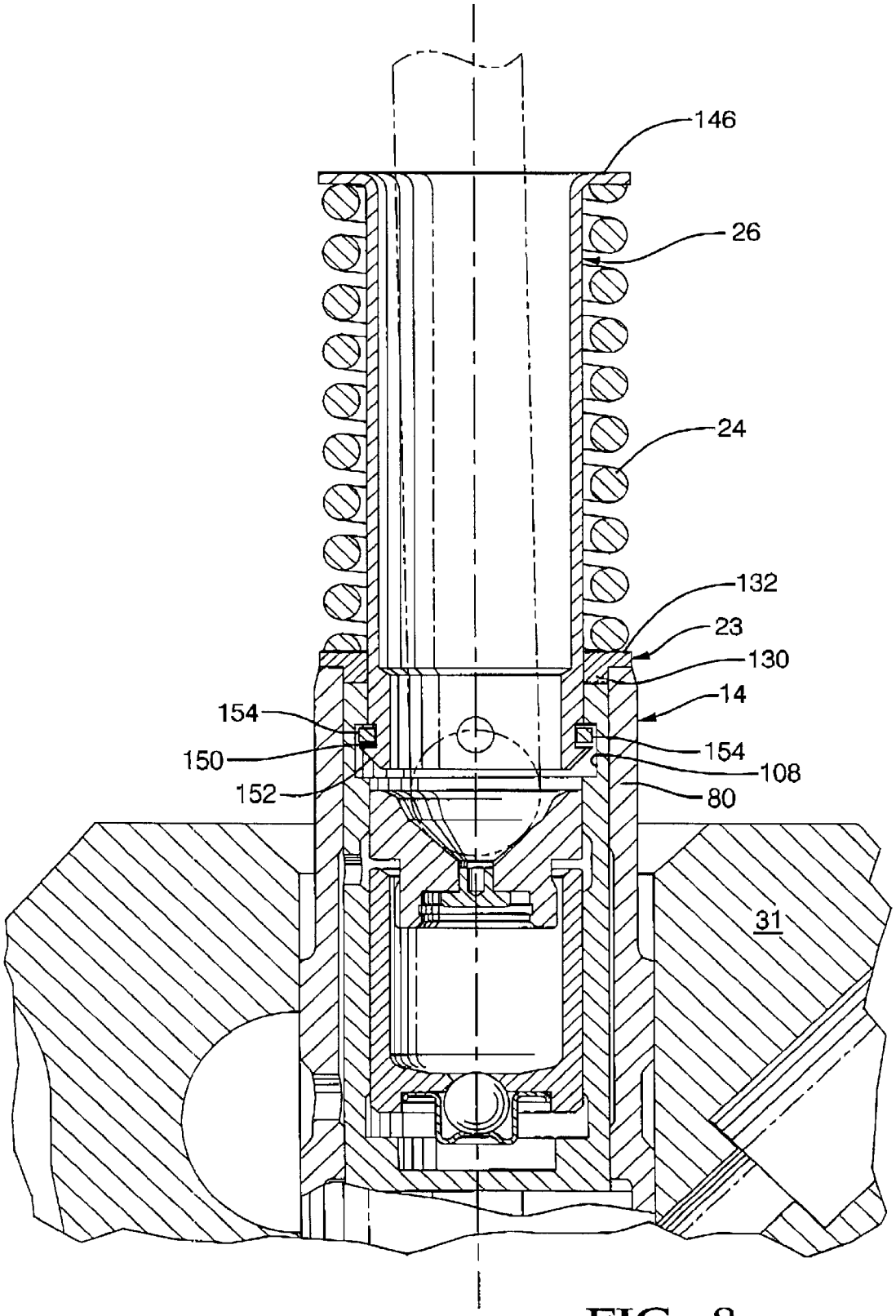
FIG. 8 is an axial cross-sectional view of an alternate configuration of the deactivation roller hydraulic valve lifter of the present invention.

Spring tower 26 may be alternately configured, as shown in FIG. 8, to include a ring groove 150 and beveled bottom edge 152. In this embodiment, a resiliently deformable retaining ring 154 is disposed within upper annular groove 108 of pin housing 20. In order to assembly DRHVL 10, spring tower 26 is pushed downward into pin housing 20. As spring tower 26 is inserted into pin housing 20 and pushed axially downward, beveled bottom edge 152 of spring tower 26 contacts retaining ring 154 which is, in turn, displaced axially downward. This downward displacement of retaining ring 154 continues until retaining ring 154 contacts the bottom of upper annular groove 108, which prevents further downward movement of retaining ring 154. As downward motion of spring tower 26 continues, beveled edge 152 then acts to expand the resiliently deformable retaining ring 154. Thus, retaining ring 154 is resiliently expanded by beveled bottom edge 152 as spring tower 26 is pushed downward into pin housing 20. The expanded retaining ring 154 slides over spring tower 26 as spring tower 26 is pushed further downward into pin housing 20. When ring groove 150 and retaining ring 154 are in axial alignment, retaining ring 154 snaps into ring groove 150. As downward pressure upon spring tower 26 is removed, the action of lost motion spring 24 exerts an upward force on spring tower 26 until retaining ring 154 contacts the top edge of upper annular groove 108. Thus, retaining ring 154 retains a portion of spring tower 26 within pin housing 20, and determines the axial position of spring tower 26 relative to pin housing 20. Spring tower 26 is constructed of, for example, hardenable or hardened steel.

In use, roller 12 is associated with and rides on a lobe of an engine cam (not shown) in a conventional manner. Shaft 30 is attached within shaft orifices 35, 36, such as, for example, by staking, to lifter body 14. Thus, as the engine cam rotates, roller 12 follows the profile of an associated cam lobe and shaft 30 translate the rotary motion of the cam and cam lobe to linear, or vertical, motion of lifter body 14. When deactivation pin assembly 16 is in its normal operating or default position, pin members 46 and 48 are biased radially outward by pin spring 50. In this default position, pin members 46 and 48 extend radially outward from within deactivation pin bore 94 and at least partially into diametrically opposed locations within annular pin chamber 42. Deactivation pin assembly 16 is configured such that pin members 46 and 48 are biased radially outward to engage annular pin chamber 42 at diametrically opposed points. Annular pin chamber 42 is filled with fluid at all times during use, the fluid being at a low pressure when deactivation pin assembly 16 is in the normal or default position.

The use of two pin members results in a substantially rigid, strong, and durable assembly which can be used at higher engine speeds, or at higher engine revolutions per minute, than an assembly having one pin or non-diametrically opposed pins. The configuration of pin members 46 and 48 as round pin members with stepped flats 46*a*, 48*a*, respectively, increases the strength of the pin members and lowers the contact stress at the interface of pin members 46 and 48 and annular pin chamber 42. Annular pin chamber 42 is configured as a contiguous circumferential pin chamber. Thus, fixing the orientation of pin housing 20 relative to lifter body 14 is not necessary in order to ensure pin members 46 and 48 will be radially aligned with contiguous annular pin chamber 42. Pin members 46 and 48 rotate with pin housing 20 and will therefore randomly engage annular pin chamber 42 at various points along the circumference of lifter body 14. Thus, the rotation of pin housing 20 relative to lifter body 14 distributes the wear incurred by annular pin chamber 42 being repeatedly engaged and disengaged by pin members 46 and 48.

With pin members 46 and 48 engaged within annular pin chamber 42 of lifter body 14, vertical movement of lifter body 14 will result in vertical movement of pin housing 20, plunger assembly 18, and pushrod seat assembly 22. Thus, lifter body 14, plunger assembly 18, pin housing 20, and pushrod seat assembly 22 are reciprocated as substantially one body when deactivation pin assembly 16 is in its default position. With pin members 46 and 48 thus engaged, a push rod (not shown) seated in pushrod seat assembly 22 will likewise undergo reciprocal vertical motion. Through valve train linkage (not shown) the reciprocal motion of a push rod associated with pushrod seat assembly 22 will act to open and close a corresponding valve (not shown) of engine 31. Fluid, such as, for example oil or hydraulic fluid, at a relatively low pressure fills annular pin chamber 42 while pin members 46, 48 are engaged within annular pin chamber 42.

Deactivation pin assembly 16 is taken out of its default position and placed into a deactivated state by the injection of a pressurized fluid, such as, for example oil or hydraulic fluid, through control port 38. The injection of the pressurized fluid is selectively controlled by, for example, a control valve (not shown) or other suitable flow control device. The pressurized fluid is injected through control port 38 and into annular pin chamber 42 at a relatively high pressure to disengage the pin members 46, 48 from within annular pin chamber 42. Close tolerances between side wall 80 of pin housing 20 and inner surface 34 of cylindrical wall 32 of lifter body 14 act to retain the pressurized fluid within annular pin chamber 42, thus providing a chamber within which the pressurized fluid flows. The pressurized fluid fills annular pin chamber 42 and exerts pressure on pin faces 47, 49. The pressure forces pin members 46 and 48 a radially inward, thereby compressing pin spring 50. Pin members 46 and 48 are thus retracted from within annular pin chamber 42 and into deactivation pin bore 94. The radially-inward movement of pin members 46 and 48 is limited by stop pins 148 which ride within stop grooves 46*b*, 48*b*.

Pin members 46 and 48 are configured with pin faces 47, 49 having a radius of curvature which matches the radius of curvature of inner surface 34, thereby providing a large active surface area against which the pressurized oil injected into annular pin chamber 42 acts to retract pin members 46 and 48 from within annular pin chamber 42. Pin members 46 and 48 are sized to be in close tolerance with deactivation pin bore 94. However, some of the pressurized fluid injected into annular pin chamber 42 may push into the area of deactivation pin bore 94 between pin members 46 and 48. If the area of deactivation pin bore 94 between pin members 46 and 48 were to fill with fluid, retraction of pin members 46 and 48 would become virtually impossible and a lock-up condition can result. Drain aperture 96 in pin housing 20 allows any of the fluid injected into annular pin chamber 42 which leaks into deactivation pin bore 94 to drain from within pin bore 94, thereby preventing a lock-up condition of pin members 46 and 48. Further, drain aperture 96 is preferably oriented in the direction of reciprocation of DRHVL 10 to take advantage of the reciprocation of DRHVL 10 to promote the drainage of fluid therethrough and, thereby, the removal of any fluid which has penetrated into deactivation pin bore 94.

With pin members 46 and 48 retracted from annular pin chamber 42, the vertical displacement of lifter body 14 through the operation of roller 12 is no longer transferred through pin members 46 and 48 to pin housing 20. Thus, pin housing 20, plunger assembly 18 and pushrod seat assembly 22 no longer move in conjunction with lifter body 14 when deactivation pin assembly 16 is in its deactivated state. Only lifter body 14 will be vertically displaced by the operation of the cam. Therefore, a push rod (not shown) seated in pushrod seat assembly 22 will not undergo reciprocal vertical motion, and will not operate its corresponding valve.

In the deactivated state, as lifter body 14 is vertically displaced by the engine cam lobe, lost motion spring 24 is compressed. As the cam lobe returns to its lowest lift profile, lost motion spring 24 expands and exerts, through spring seat 23, a downward force on lifter body 14 until flange 132 and collar 130 simultaneously contact lifter body 14 and pin housing 20, respectively. Any lift loss that occurs due to leakdown is recovered through the expanding action of plunger spring 64. Thus, the lash remaining in DRHVL 10 is limited to the gap G which is precisely set through the dimensions of spring seat 23. Excessive lash will accelerate wear of valve train components. Thus, where excessive lash exists, the interfacing components are pounded together as they are reciprocated by the cam. The pounding significantly increases wear and tear of the components, and possibly premature lifter or valve train failure. As will be described in more detail hereinafter, spring seat 23 sets an appropriate amount of lash, thereby preventing excessive wear and premature valve train failure. The dimensions of spring seat 23 are precisely controlled during manufacture. Thus, gap G and the amount of lash incorporated into DRHVL 10 are precisely controlled.

Lost motion spring 24 prevents separation between DRHVL 10 and the engine cam in the in the deactivated or disengaged state. Further, lost motion spring 24 resists the expansion of DRHVL 10 when the cam is at its lowest lift profile position. The tendency of DRHVL 10 to expand is due to the force exerted by plunger spring 64 and oil pressure within high pressure chamber 100 acting upon plunger 60. These forces tend to displace pin housing 20 downward toward roller 12, thereby reducing gap G. Thus, the oil pressure within high pressure chamber 100 and the force exerted by plunger spring 64 will expand, or pump-up, DRHVL 10 by displacing pin housing 20 downward toward roller 12. Spring tower 26 is firmly engaged with pin housing 20, and thus any downward movement of or force upon pin housing 20 will be transferred to spring tower 26. Thus, a compressive force, or a force in a direction toward roller 12, is exerted upon lost motion spring 24 via the downward force or movement of pin housing which is transferred to spring tower 26. The pre-load or installed load of lost motion spring 24 is selected to resist the tendency of DRHVL 10 to pump-up or expand. If expansion is not resisted or limited by the installed load of lost motion spring 24, gap G will be reduced as pin housing 20 is displaced downward relative to pin chamber 42. Such unrestrained expansion and downward displacement of pin housing 20 may potentially adversely affect the ability of locking pin members 46, 48 to engage within pin chamber 42. If lost motion spring 24 is inadequately sized, gap G could be reduced an amount sufficient to prohibit the engagement of locking pins 46, 48 within pin chamber 42. Thus, lost motion spring 24 must be selected to resist the compressive forces exerted thereon due to the hydraulic element, operating oil pressure, and plunger spring.

Disposing lost motion spring 24 above lifter body 14, but within the plan envelope of DRHVL 10, provides increased space in which a larger lost motion spring 24 can be accommodated, which, in turn, enables the use in DRHVL 10 of a larger hydraulic element, higher operating oil pressure, and stronger plunger spring. Further, disposing lost motion spring 24 within the plan envelope of DRHVL 10 permits the insertion of DRHVL 10 into a standard-sized lifter anti-rotation guide. Spring tower 26 is, in effect, a reduced-diameter extension of pin housing 20. The diameter of spring tower 26 is a predetermined amount less than the diameter of pin housing 20 such that lost motion spring 24 can be of sufficient size and yet remain within the plan envelope of lifter body 14. Thus, spring tower 26 enables lost motion spring 24 to be appropriately sized and remain within the plan envelope of DRHVL 10.

Spring seat 23 is disposed intermediate lifter body 14 and lost motion spring 24. Spring seat 23 determines the relative positions of lifter body 14 and pin housing 20. More particularly, the axial dimension, or length, of collar 130 determines the relative axial positions of lifter body 14 and pin housing 20. As show in FIG. 3, gap G exists between the bottom of annular pin chamber 42 and the bottom of pin faces 47, 49. By changing the axial dimension of collar 130 gap G can be precisely manipulated. For example, lengthening collar 130 places pin housing 20 axially lower relative to lifter body 14 thereby decreasing the height of gap G. By adjusting the axial dimension of collar 130, variations in manufacturing tolerances and variations in the dimensions of the component parts of DRHVL 10 can be accurately compensated for while a tight tolerance on gap G is accurately maintained. Flexibility in manufacture and assembly is accomplished by manufacturing a number of spring seats 23 having collars 130 of various predetermined axial dimensions. A particular spring seat 23 would be selected based upon the axial dimension of collar 130 in order to produce a DRHVL 10 having an appropriately-sized gap G.

In the embodiment shown, lifter body 14 is sized to be received within a standard-sized anti-rotation guide or within a standard-sized lifter bore of a push-rod type internal combustion engine. However, it is to be understood that lifter body 14 may be alternately configured to have a greater or smaller size and/or diameter and therefore be received within variously sized lifter bores and/or anti-rotation guides.

In the embodiment shown, annular pin chamber 42 is disclosed as being configured as a contiguous annular pin chamber. However, it is to be understood that annular pin chamber 42 may be alternately configured, such as, for example, as two or more non-contiguous annular chambers configured to receive a corresponding one of deactivation pin members 46 and 48. In this configuration, each annular pin chamber includes a corresponding control port through which the pressurized fluid is injected to retract a respective pin member from within the corresponding annular pin chamber.

In the embodiment shown, pin members 46 and 48 are disclosed as round pin members having flats 46*a*, 48*a*, respectively. However, it is to be understood that pin members 46 and 48 may be alternately configured, such as, for example, square or oval pin members having respective flats, or may be configured without flats, and be received within a correspondingly configured pin chamber.

In the embodiment shown, plunger ball 62 and ball retainer 66 conjunctively define a ball-type check valve. However, it is to be understood that DRHVL 10 may be alternately configured with, such as, for example, a plate-type check valve or any other suitable valve.

In the embodiment shown, deactivation pin assembly 16 includes two pin members 46, 48. However, it is to be understood that deactivation pin assembly 16 may include a single pin member or any desired number of pin members.

In the embodiment shown, stop pins 148 are disposed within a respective one of stop pin apertures 98 and extend radially inward to intersect with one side wall of deactivation pin bore 94. However, it is to be understood that stop pin apertures 98 may extend radially inward from locations on opposite sides of pin housing 20 and intersect with opposite side walls of deactivation pin bore 94.

In the embodiment shown, insert 124 is inserted by, for example, pressing into pushrod seat orifice 122. However, it is to be understood that insert 124 may be alternately configured, such as, for example, otherwise attached to or formed integrally with push rod seat 22.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed:

1. A deactivation hydraulic valve lifter, comprising:

an elongate lifter body having a substantially cylindrical inner wall, said inner wall defining at least one annular pin chamber therein, said lifter body having a lower end configured for engaging a cam of an engine;

an elongate pin housing including a substantially cylindrical pin housing wall and pin housing bottom, said pin housing wall having an inner surface and an outer surface, said pin housing bottom defining a radially directed pin bore therethrough, said pin housing being substantially concentrically disposed within said inner wall of said lifter body such that said outer surface of said pin housing wall is adjacent to at least a portion of said inner wall of said lifter body;

a plunger having a substantially cylindrical plunger wall, said plunger wall having an inner surface and an outer surface, said plunger being substantially concentrically disposed within said pin housing such that and outer surface of said plunger wall is adjacent to at least a portion of said inner surface of said pin housing wall;

a deactivation pin assembly disposed at least partially within said pin bore, said deactivation pin assembly including two pin members, said pin members biased radially outward relative to each other, at least a portion of each said pin member being disposed within a corresponding one of said at least one annular pin chamber to thereby couple said lifter body to ad pin housing , said pin members being configured for moving toward each other when said at least one annular pin chamber is pressurized, thereby retracting said pin members from within a corresponding one of said at least one annular pin chamber and decoupling said lifter body from said pin housing;

an elongate spring tower including a substantially cylindrical tower wall, said tower wall having a first end and a flanged end, said spring tower being substantially concentrically disposed relative to said pin housing, said first end of said tower wall being coupled to said inner surface of said pin housing wall, said cylindrical tower wall extending axially from within said pin housing wall a predetermined distance above a top end of said lifter body, and a lost motion spring having a first end and a second end, said first end engaging said flanged end of said spring tower, said second end associated with said top end of said lifter body, said lost motion spring being compressed between said top end of said lifter body and said flanged end of said spring tower, said lost motion spring configured for exerting a force in a first axial direction upon said lifter body and in a second axial direction upon said spring tower, said first axial direction being opposite to said second axial direction.

2. The deactivation hydraulic value lifter of claim 1, wherein said lifter body defines at least one control port therethrough, each said at least one control port in fluid communication with a corresponding one of said at least one annular pin chamber, each of said at least one control port configured for having a flow of pressurized fluid injected therethrough and into a corresponding one of said at least one annular pin chamber, the pressurized fluid pushing each said pin member from within a corresponding one of said at least one pin chamber to thereby retract said pin members and decouple said lifter body from said pin housing.

3. The deactivation hydraulic valve lifter of claim 1, wherein said at least one annular pin chamber comprises a contiguous annular pin chamber extending around a circumference of said cylindrical inner wall of said lifter body.

4. The deactivation hydraulic valve lifter of claim 1, wherein each said pin member includes a respective front surface and a respective rear surface, each said front surface being disposed radially outward of a corresponding rear surface relative to said pin housing, a pin spring interconnecting said rear surfaces of each said pin member, said pin spring biasing each said pin member radially outward relative to said pin housing such that each respective front surface is disposed within a corresponding one of said at least one annular pin chamber to thereby couple said lifter body to said pin housing.

5. The deactivation hydraulic valve lifter of claim 4, wherein each said pin member is substantially cylindrical.

6. The deactivation hydraulic valve lifter of claim 4, wherein each respective front face of each said pin member defines a stepped flat.

7. The deactivation hydraulic valve lifter of claim 4, wherein each respective front face has a first radius of curvature, said inner wall of said lifter body having a second radius of curvature, said first radius of curvature being substantially equal to said second radius of curvature.

8. The deactivation hydraulic valve lifter of claim 4, wherein each said pin member includes a respective stop groove, each said stop groove extending a predetermined distance from a respective said rear bore of a respective said pin member toward a respective said front face of a respective said pin member.

9. The deactivation hydraulic valve lifter of claim 1, wherein said bottom end of said spring tower includes at least one pair of diametrically opposed tabs formed thereon, said tabs extending radially outward from said bottom end of said spring tower, said inner surface of said pin housing wall defining at least one upper annular groove therein, said tabs being disposed within a respective one of said at least one upper annular groove to thereby couple said spring tower to said pin housing.

10. The deactivation hydraulic valve lifter of claim 1, wherein said bottom end of said spring tower comprises a beveled edge, a ring groove being disposed proximate to said beveled edge intermediate said beveled edge and said flanged end, said inner surface of said pin housing wall defining an upper annular groove therein, a resiliently expandable retaining ring being disposed within said upper annular groove, said beveled edge being configured for expanding said retaining ring, said retaining ring being configured for engaging said ring groove of said spring tower to thereby couple said spring tower to said pin housing.

11. The deactivation hydraulic valve lifter of claim 1, wherein said lost motion spring comprises a coil spring, said coil spring being disposed around an outside surface of said tower wall.

12. The deactivation hydraulic valve lifter of claim 1, further comprising a spring seat, said spring seat comprising a substantially cylindrical collar portion and a substantially cylindrical flange portion, a spring seat orifice defined by said spring seat, said flange portion being disposed on said upper end of said lifter body, said collar portion being disposed substantially concentrically within said lifter body adjacent an upper end of said pin housing such that said spring seat orifice is substantially concentric with said lifter body and said pin housing, said spring seat orifice surrounding a portion of an outer surface of said tower wall, said second end of said lost motion spring engaging said flange portion of said spring seat.

13. The deactivation hydraulic valve lifter of claim 12, wherein said collar portion of said spring seat is disposed within said lifter body, said collar portion having a length and a first end, said length extending in an axial direction relative to said lifter body, said first end contacting said pin housing, said length determining the axial position of said pin housing relative to said lifter body when said lifter body is coupled to said pin housing.

14. The deactivation hydraulic valve lifter of claim 1, wherein said pin housing defines at least one stop pin aperture therein, said at least one stop pin aperture being substantially perpendicular to said pin bore, said at least one stop pin aperture extending form said outer surface of said pin housing wall into said pin bore, said at least one stop pin aperture terminating within said pin bore, a stop pin being disposed within each of said at least one stop pin aperture and extending at least partially into said pin bore, each said stop pin being configured for limiting the radially inward motion of said pin members.

15. The deactivation hydraulic valve lifter of claim 14, wherein each said stop pin is configured for preventing rotation of a corresponding one of said pin members.

16. The deactivation hydraulic valve lifter of claim 14, wherein each said pin member includes a respective front face and a respective rear bore, each said front face being disposed radially outward of a corresponding rear bore relative to said pin housing, each said pin member including a respective stop groove, each said stop groove extending a predetermined distance from a respective said rear bore of a respective said pin member toward a respective said front face of a respective said pin member, a respective said stop pin being disposed within a corresponding one of each said stop groove.

17. An internal combustion engine, comprising:

a deactivation hydraulic valve lifter, including:

an elongate lifter body having a substantially cylindrical inner wall, said inner wall defining at least one annular pin chamber therein, said lifter body having a lower end configured for engaging a cam of the engine;

an elongate pin housing including a substantially cylindrical pin housing wall and pin housing bottom, said pin housing wall having an inner surface and an outer surface, said pin housing bottom defining a radially directed pin bore therethrough, said pin housing concentrically disposed within said inner wall of said lifter body such that said outer surface of said pin housing wall is adjacent to at least a portion of said inner wall of said lifter body;

a plunger having a substantially cylindrical plunger wall, said plunger wall having an inner surface and an outer surface, said plunger being concentrically disposed within said pin housing such that said outer surface of said plunger wall is adjacent at least a portion of said inner surface of said pin housing wall;

a deactivation pin assembly disposed at least partially within said pin bore, said deactivation pin assembly including two pin members, said pin members biased radially outward relative to each other, at least a portion of each said pin member being disposed within a corresponding one of said at least one annular pin chamber to thereby couple said lifter body to said pin housing, said pin nearness being configured for moving toward each other when said at least one annular pin chamber is pressurized, thereby retracting said pin members from within a respective one of said at least one annular pin chamber and decoupling said lifter body from said pin housing;

an elongate spring tower including a cylindrical tower wall, said tower wall having a first end and a flanged end, said spring tower concentrically disposed relative to said pin housing, said first end being coupled to said inner surface of said pin housing, said cylindrical tower wall extending axially from within said pin housing wall a predetermined distance above a top end of said lifter body; and a lost motion spring having a first end and a second end, said first end engaging said flanged end of said spring tower, said second end associated with said top end of said lifter body, said lost motion spring configured for exerting an upward force on said flanged end of said spring tower and a downward force on said lifter body.

18. The internal combustion engine of claim 17, wherein said at least one annular pin chamber comprises a contiguous annular pin chamber extending around a circumference of said cylindrical inner wall of said lifter body.

19. The internal combustion engine of claim 17, wherein each said pin member includes a respective front surface and a respective rear surface, each said front surface being disposed radially outward of a corresponding rear surface relative to said pin housing, a pin spring interconnecting said rear surfaces of each said pin member, said pin spring biasing each said pin member radially outward relative to said pin housing such that each respective front surface is disposed within a corresponding one of said at least one annular pin chamber to thereby couple said lifter body to said pin housing.

20. The internal combustion engine of claim 19, wherein each said pin member is substantially cylindrical.

21. The internal combustion engine of claim 19, wherein each respective front face of each said pin member defines a stepped flat.

22. The internal combustion engine of claim 19, wherein each respective front face has a first radius of curvature, said inner wall of said lifter body having a second radius of curvature, said first radius of curvature being substantially equal to said second radius of curvature.

23. The internal combustion engine of claim 19, wherein each said pin member includes a respective stop groove, each said stop groove extending a predetermined distance from a respective said rear bore of a respective said pin member toward a respective said front face of a respective said pin member.

24. The internal combustion engine of claim 17, wherein said deactivation hydraulic valve lifter further comprises a spring seat, said spring seat including a cylindrical collar portion and a cylindrical flange portion, a spring seat orifice defined by said spring seat, said flange portion being disposed on said upper end of said lifter s body, said collar portion being disposed concentrically within said lifter body adjacent an upper end of said pin housing such that said spring seat orifice is substantially concentric with said lifter body and said pin housing, said spring seat orifice surrounding a portion of an outer surface of said tower wall, said second end of said lost motion spring engaging said flange portion of said spring seat.

25. The internal combustion engine of claim 24, wherein said collar portion has a length and a first end, said length extending in an axial direction relative to said lifter body, said first end contacting said pin housing, said length determining the axial position of said pin housing relative to said lifter body when said lifter body is coupled to said pin housing.

* * * * *